US007419066B1

(12) United States Patent
Ewers

(10) Patent No.: US 7,419,066 B1
(45) Date of Patent: Sep. 2, 2008

(54) VENTED CAP FOR FLUID CONDUIT

(76) Inventor: Ronald Ewers, 607 NW. 27th Ave., Ocala, FL (US) 34475

( * ) Notice: Subject to any disclaimer, the term of this patent is extended or adjusted under 35 U.S.C. 154(b) by 129 days.

(21) Appl. No.: 10/681,617

(22) Filed: Oct. 8, 2003

Related U.S. Application Data

(60) Provisional application No. 60/417,275, filed on Oct. 8, 2002.

(51) Int. Cl.
*B65D 51/16* (2006.01)

(52) U.S. Cl. ..... 220/303; 215/309

(58) Field of Classification Search ..... 222/478; 215/307, 309, 310, 305, 248; 220/366.1, 220/367.1, 303
See application file for complete search history.

(56) References Cited

U.S. PATENT DOCUMENTS 3,927,798 A * 12/1975 Loomis ..... 220/374
4,168,012 A * 9/1979 Hawkinson ..... 220/203.16
4,881,657 A * 11/1989 Capasso ..... 220/303
5,356,021 A * 10/1994 McBride et al. ..... 215/349
5,564,582 A * 10/1996 Kamath ..... 215/252
5,762,217 A * 6/1998 Ohmi et al. ..... 215/253
5,894,953 A * 4/1999 Ramirez ..... 220/785

* cited by examiner

*Primary Examiner*—Lien M. Ngo
(74) *Attorney, Agent, or Firm*—Allen, Dyer, Doppelt, Milbrath & Gilchrist, P.A.

(57) ABSTRACT

A vented cap for a pressurized fluid conduit includes a cap body defining a generally cylindrical inner cavity, a mouth, an end wall positioned so as to close the inner cavity, a plurality of threads extending generally from the mouth toward the end wall, and at least one lug member on an outer surface of the cap and having a vent slot extending along a lengthwise interior so that the slot has a first end beginning at the mouth and a second end spaced apart from the end wall and extends inwardly from the lug member toward the inner cavity through the plurality of threads so as to open into the inner cavity, and a gasket having a circumference complementary to the periphery of the inner cavity, the gasket positioned between the plurality of threads and the end wall abuttingly contacting the sidewall and the end wall.

31 Claims, 6 Drawing Sheets

VENTED CAP FOR FLUID CONDUIT

RELATED APPLICATION

This application claims priority from co-pending provisional application Ser. No. 60/417,275, which was filed on Oct. 8, 2002, and which is incorporated herein by reference in its entirety.

FIELD OF THE INVENTION

The present invention relates to the field of high pressure fluid systems and, more specifically, to a vented cap for a high pressure water system such as in a fire engine.

BACKGROUND OF THE INVENTION

High pressure water systems are found in fire engines and are used to pump large volumes of water under pressure to supply fire hoses for fighting fires. Capped connection fittings for these high pressure water systems are positioned on fire engine control panels for connecting fire hoses and other water lines. Typically, these connection fittings are closed off with a cap which engages the fitting by complementary threads. The pipes, fittings, valves, and end caps in these systems are manufactured of high strength materials such as stainless steel, so that they will maintain their integrity in the high pressure environment.

A particular problem in these high pressure water systems, and safety hazard to firefighters, occurs when loosening and removing an end cap from a system outlet which may be pressurized. It is well known in the firefighting arts that such a cap loosened from a pressurized outlet may become a dangerous projectile when dislodged and propelled outwardly by the pressure in the system. For that reason, outlet caps are typically attached to the outlet fitting by a short chain which tends to prevent the cap from flying away from the fitting if loosened when the system is pressurized.

SUMMARY OF THE INVENTION

With the foregoing in mind, the present invention advantageously provides a vented cap for a pressurized fluid conduit. The cap is well suited for use in the high pressure water system of a fire engine, but is also usable in many other fluid systems wherefrom pressure may be released when disconnecting the cap. The cap comprises a cap body, a mouth, an end wall, a plurality of threads, and at least one and preferably a plurality of lugs. The cap body has a sidewall defining a generally cylindrical inner cavity having a first end and a second end spaced apart therefrom. A cap mouth is defined by a periphery of said sidewall at said first end and opening into said inner cavity. An end wall is positioned at said second end so as to close said inner cavity. A plurality of threads is positioned along an inner surface of said sidewall and extend generally from said mouth toward said end wall, ending spaced apart therefrom. At least one lug member extends outwardly from an outer surface of said sidewall and has a lengthwise extent positioned generally parallel to a central axis of said inner cavity, said lug member having a vent slot extending along the lengthwise interior extent of said lug member so that the slot has a first end beginning at said mouth and a second end spaced apart from said end wall. The vent slot extends inwardly from said lug member toward said inner cavity through the sidewall and through the plurality of threads so as to form a vent opening into said inner cavity. A gasket having a circumference complementary to the periphery of said inner cavity is positioned between said plurality of threads and said end wall abuttingly contacting said sidewall and said end wall.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which.

DETAILED DESCRIPTION OF THE PREFERRED EMBODIMENT

Figure 1:
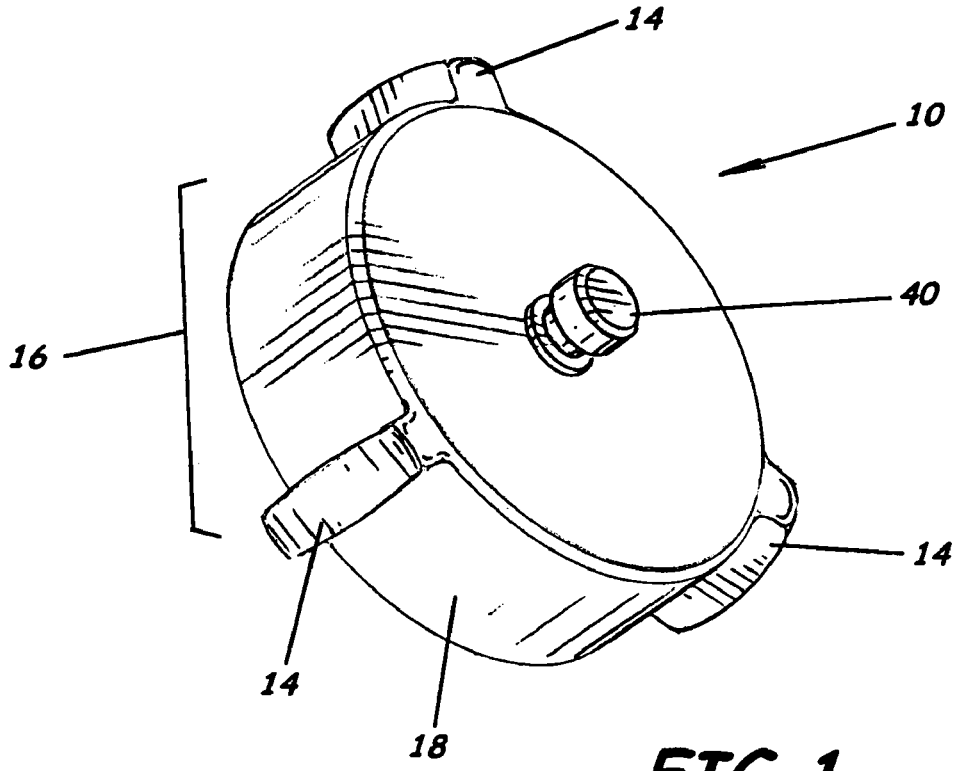
FIG. 1 is a top perspective view of the vented cap according to an embodiment of the present invention.
Figure 2:
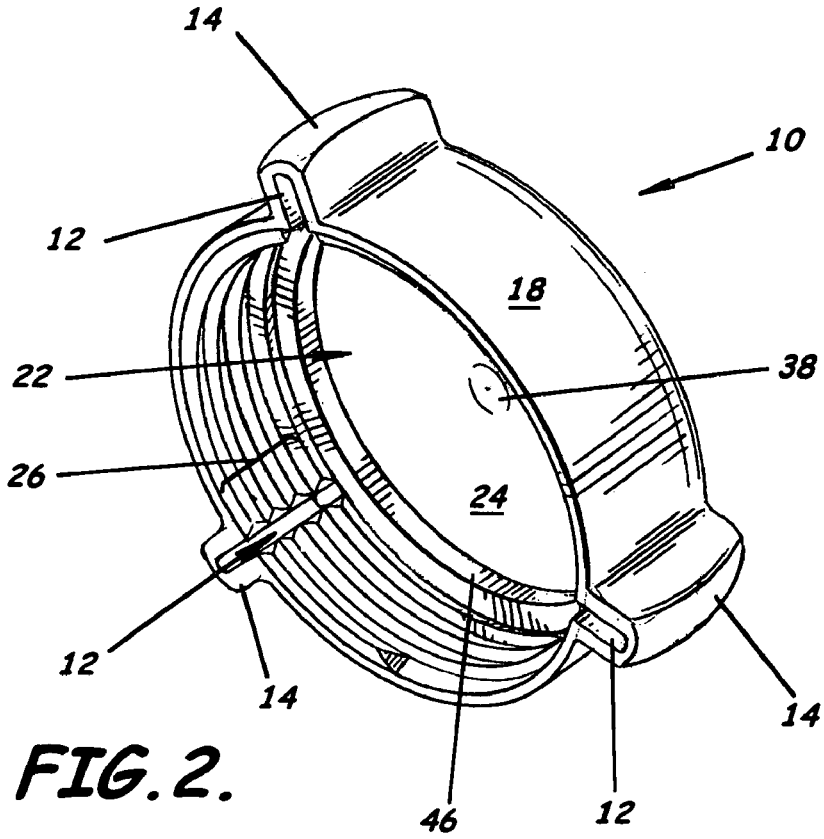
FIG. 2 is a bottom perspective view of the vented cap of FIG. 1.
Figure 3:
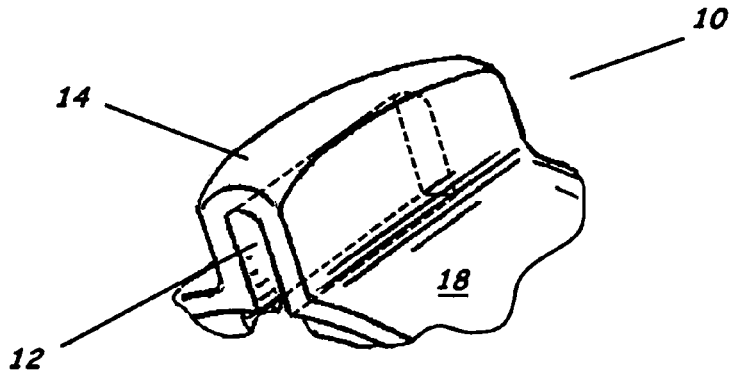
FIG. 3 shows a view of a vent slot positioned in a lug of the cap of FIG.
Figure 4:
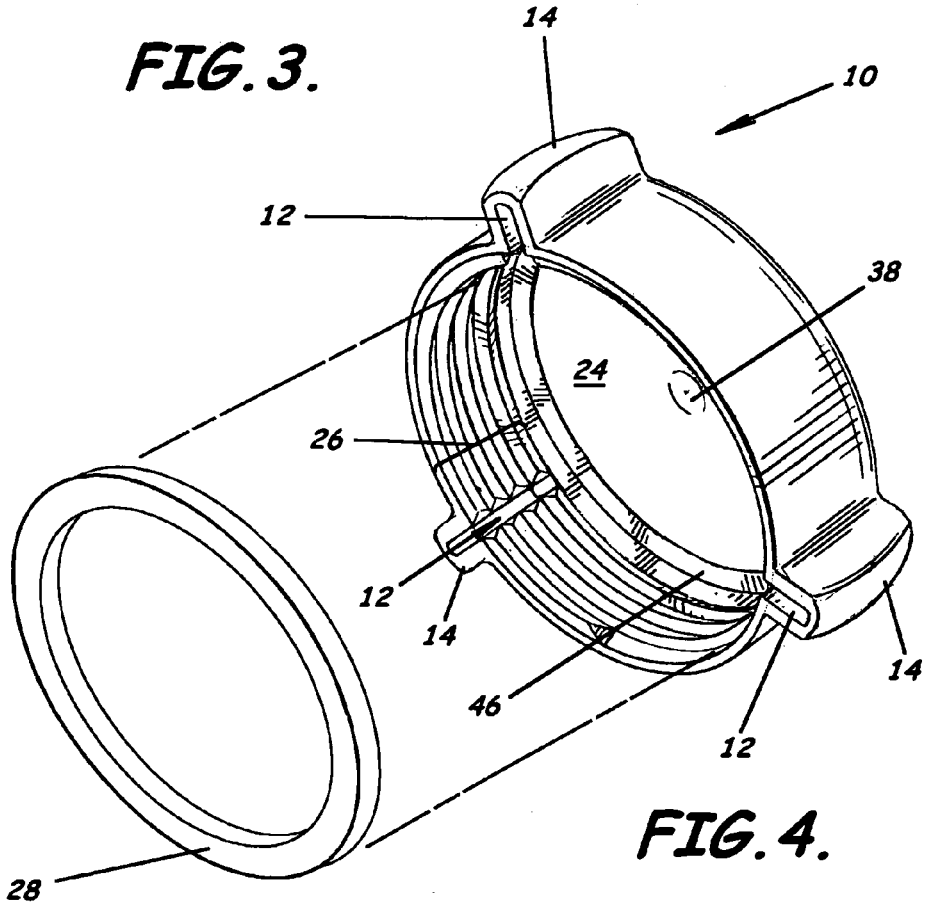
FIG. 4 depicts the cap of FIG. 1 and its gasket.
Figure 5:
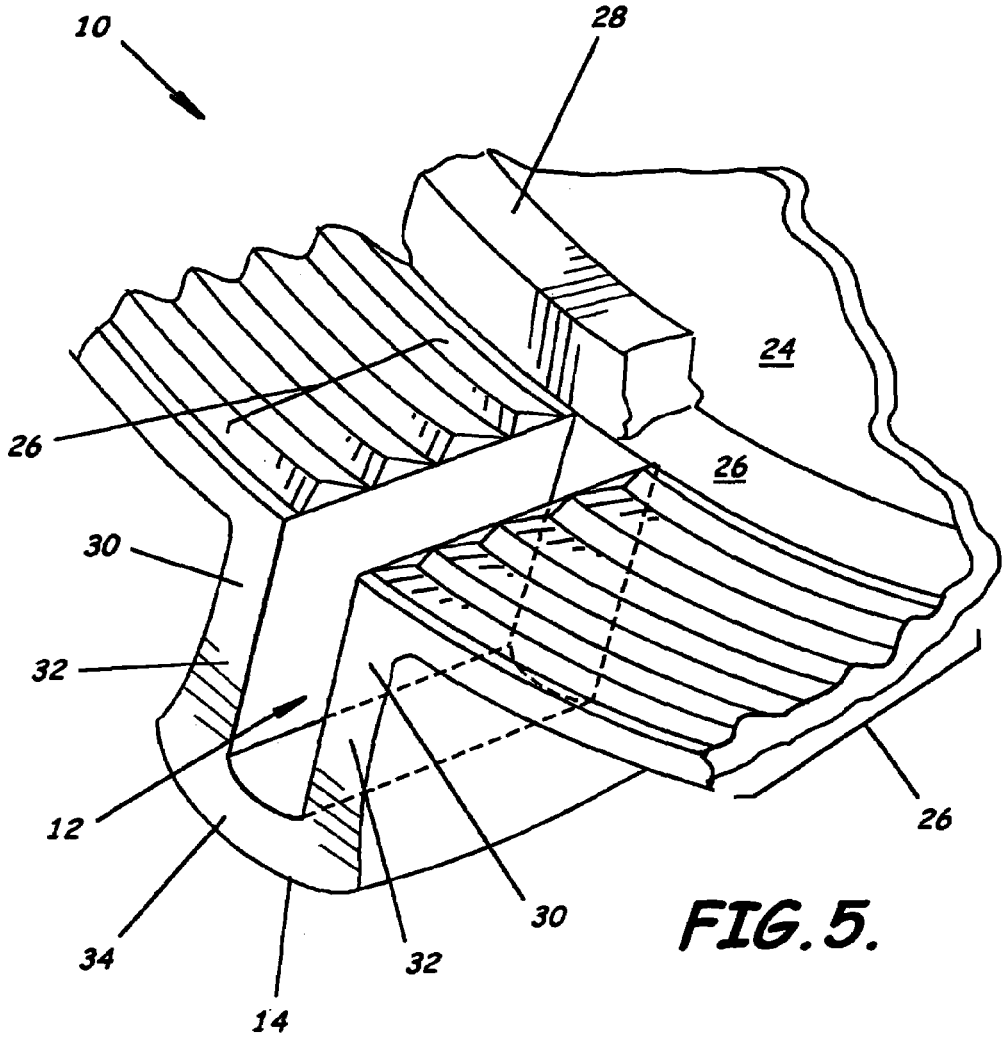
FIG. 5 shows the relationship of a vent slot, threads, and cap gasket.
Figure 6:
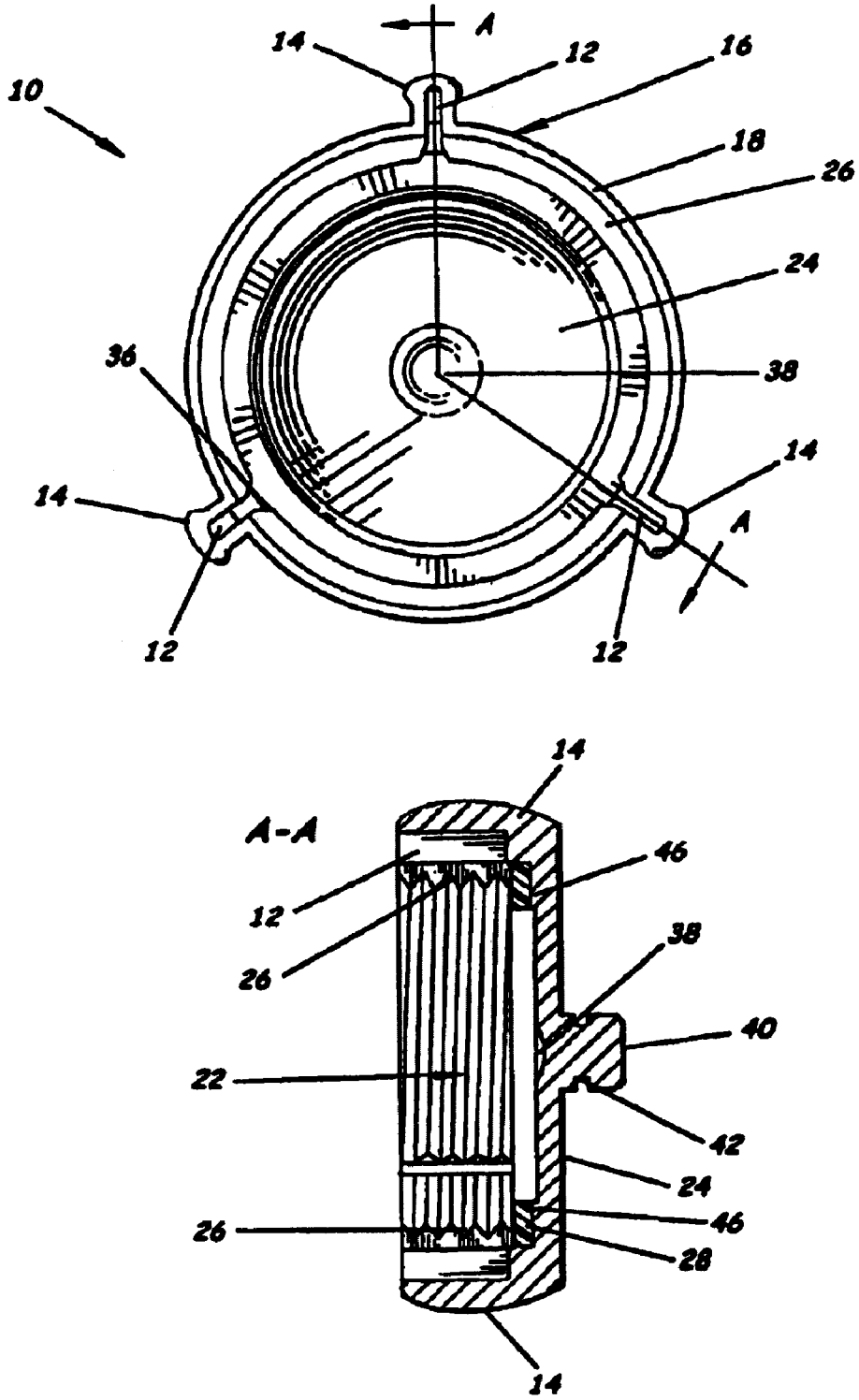
FIG. 6 is a bottom plan view of the cap of FIG. 1, wherein section A—A shows a cross sectional side view of same.

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Embodiments of the vented cap 10 of the present invention are shown in FIGS. 1–7. Previous end caps for high pressure water systems either did not include pressure release vents, or included them as cuts made through the cap's threads and also through the complementary threads of the outlet fitting. Manufacturers of carbonated soft drinks have for years incorporated these cuts in the complementary threads found on plastic bottles and bottle caps in order to gently release pressure when the soft drink bottle is opened by the consumer.

Nevertheless, the approach taken with softdrink bottles, if applied to the pressurized water system in a fire engine, would require positioning cuts through the threads of both the outlet fitting and the end cap, and could result in a weaker connection between the two when matingly engaged via their threads. In addition, upon loosening the cap, the pressure is only released in spurts as the cuts on the cap threads and the cuts on outlet fitting's threads align temporarily while the cap is being turned. As expected, when loosening the end cap, the alignment of the cuts is sporadic and temporary as the cap is being turned, and pressure release occurs in discrete discharges. Further, in order to retrofit an existing fire engine with the old device such as exemplified by soft drink bottles, the fire department would have to pay to replace the outlet fittings on the fire engine, and could not simply install new caps on the existing outlet fittings.

With the foregoing in mind and as shown in the figures, the present invention provides a vented cap 10 having venting slots 12 positioned within the cap lugs 14, a novel structural arrangement which avoids having to cut the threads in the complementary outlet fitting. The present vented cap 10, as will be appreciated from FIGS. 1–7, permits constant venting of pressure once the cap is slightly loosened and contact is broken between the lip of an outlet fitting 48 on which the cap 10 is connected and a gasket 28 ring seal positioned inside the vent cap. The inventive vented cap 10, therefore, allows constant venting of pressure while the cap is being loosened. By contrast, as noted above, previous devices provide only intermittent venting as the cap is loosened, due to the need for the alignment of vent slots positioned on the cap and their complementaries on the outlet fitting. Additionally, the present threaded vented cap 10 is believed to provide a stronger coupling when properly engaged with its complementary threaded outlet fitting 48, as the threads on the fitting remain intact and uncut. Those skilled in the art will further appreciate that the present vented cap 10 will require less expensive manufacturing, as cuts need only be made in the cap and not also in the complementary outlet fitting 48. Furthermore, fire departments and other clients seeking to retrofit existing fire trucks will be required to purchase only the present vented cap 10, whereas in the past they would have had to purchase both a new cap and a new outlet fitting as well. For those reasons, the present vented cap 10 provides a more attractive product both for the manufacturer and for the user.

The skilled will also readily recognize that the vented cap 10 herein disclosed may be employed not only in the high pressure water system in a fire engine, but may also be advantageously put to use in many other high pressure fluid systems. The device and method of the invention are also applicable to hose end fittings as well, as these also include "rocker" lugs which are used in helping to connect and disconnect hoses. These hose connections can similarly benefit from this style vent coupling when unscrewed with the hose line under some residual pressure. Typically, when disconnecting hoses under pressure, the firefighter will first open bleeder valves to release pressure from the hose, however, it is well known that operating procedures are not always faithfully followed. Alternatively, the bleeder valve could be damaged, preventing its use and leaving residual pressure within the hose. The present venting methodology would be well suited to these circumstances. The invention is, therefore, not limited to fire engine high pressure water systems, but is also intended for use in any other high pressure fluid system wherein it may be of advantage.

We turn now to the details of the present invention, a vented cap 10 for a pressurized fluid conduit. A cap body 16 includes a sidewall 18 defining a generally cylindrical inner cavity 20 having a first end and a second end spaced apart therefrom, a mouth 22 defined by a periphery of the sidewall at the first end and opening into the inner cavity, an end wall positioned at the second end so as to close the inner cavity, a plurality of threads positioned along an inner surface of the sidewall and extending generally from the mouth toward the end wall and ending spaced apart therefrom, and at least one lug member 14 extending outwardly from an outer surface of the sidewall. The lug member 14 has a lengthwise extent positioned generally parallel to a central axis of the inner cavity, and a vent slot 12 extending along the lengthwise interior extent of the lug member 14 so that the slot has a first end beginning at the mouth 22 and a second end spaced apart from the end wall 24. The vent slot 12 further extends inwardly from the lug member 14 toward the inner cavity 20 through the sidewall 18 and through the plurality of threads 26 so as to open into the inner cavity. The cap 10 also includes a gasket 28 having a circumference complementary to the periphery of the inner cavity 20, the gasket positioned between the plurality of threads 26 and the end wall 28 abuttingly contacting the sidewall 18 and the end wall 24.

Figure 7:
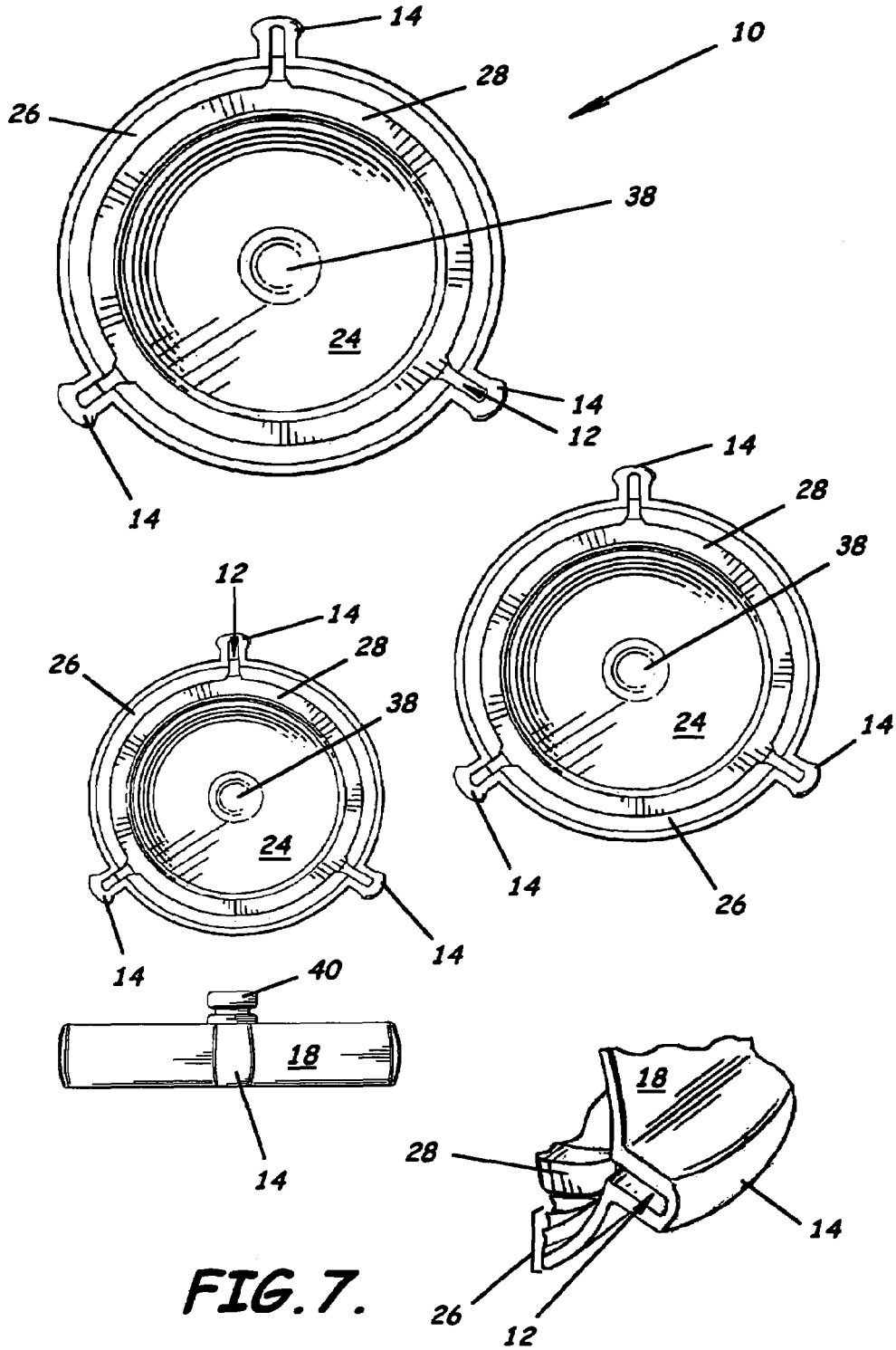
FIG. 7 shows bottom plan views of caps of several sizes according to the present invention, a side elevation view of the smallest cap, and a detail view of a vent slot in a cap lug.
Figure 8:
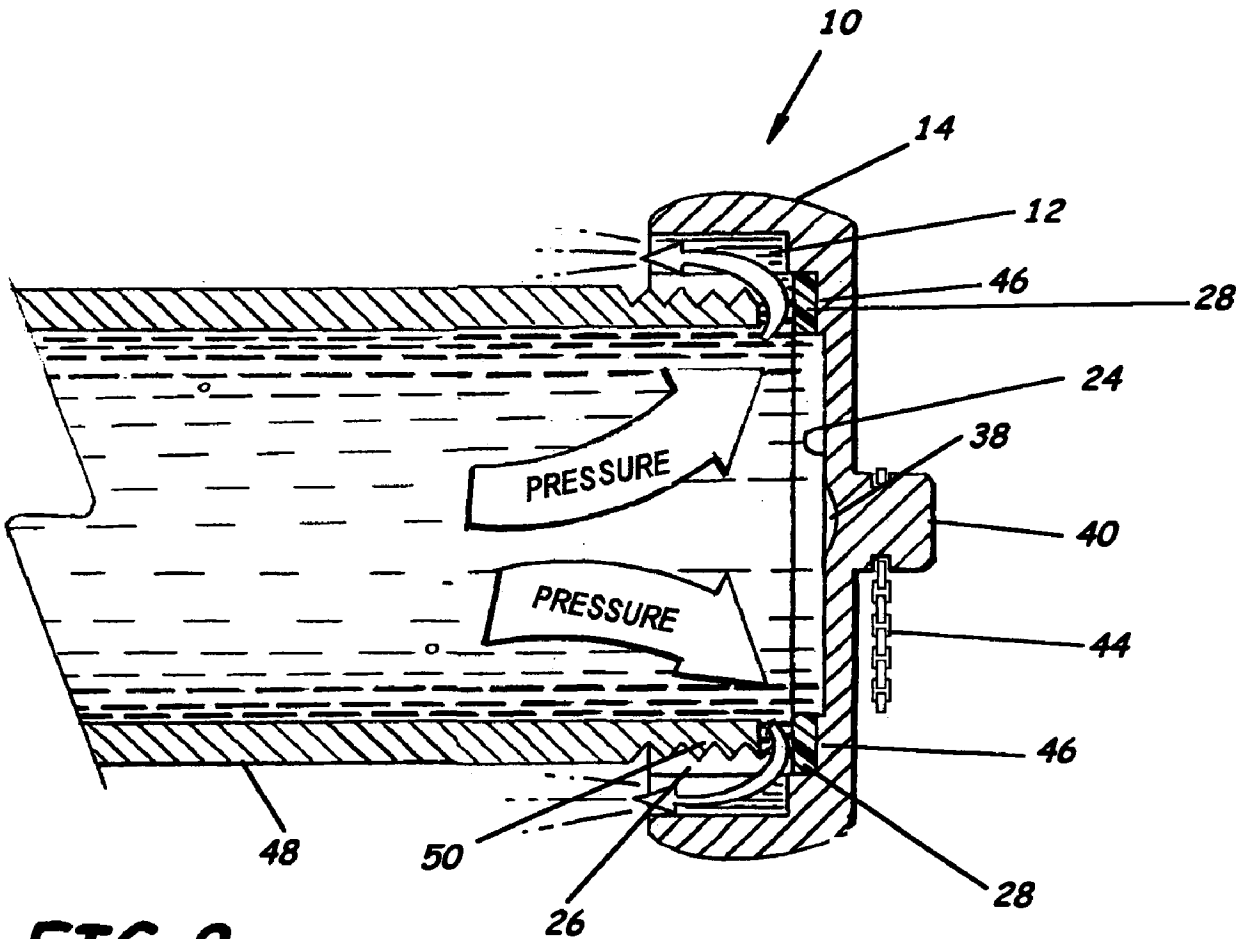
FIG. 8 is a side cross sectional view of the cap of FIG. 1 in combination with its complementary fitting.

The lug member 14 preferably has a base coextensive 30 with the outer surface of the sidewall, two lateral walls 32, and an end wall 34. The two lateral walls 32 are preferably concavely arcuate, and the end wall 34 is convexly arcuate, as shown in FIG. 7. In a preferred embodiment of the invention, the vent slot 14 is positioned extending along a central lengthwise dimension of the at least one lug member, and the plurality of threads 26 is cut along the vent slot 12 to form a bevel 36 having approximately a 45° angle to a center axis of the vent slot 12.

Additional structural features of the vented cap 10 include wherein an inner surface of the end wall 24 includes a central concavity 38 which extends to form a knob 40 protruding from an exterior surface of the end wall. In one preferred embodiment, the knob 40 is generally outwardly cylindrical and includes a groove 42 extending along a lateral circumference, the groove most preferably being arcuate as seen in FIG. 7. The vented cap 10 best includes a chain 44 fastened around the arcuate groove 12, so as to provide a connection to a fixed point on a fire engine, thereby helping prevent the cap from being accidentally discharged as a projectile from its connection when being loosened from a fitting.

The vented cap 10 may also include an end wall 24 further comprising a shelf 46 positioned peripherally along an inner surface of the end wall 24, the shelf being slightly raised above a central area of the inner surface of the end wall. The gasket 28 fits on the raised shelf 46, the gasket seal being circular, having an inner diameter, an outer diameter, and a generally rectangular cross-section. The generally rectangular cross-section includes a length lying along a radius of the gasket, and perpendicular thereto and a height sufficient for a surface of the gasket to be positioned in the cap 10 approximately level with the second end of the vent slot, as shown in Section A—A of FIG. 6.

Yet an additional aspect of the invention includes a vented cap 10 and fitting 48 combination for a fluid conduit. The fitting 48 has a generally hollow cylindrical body having an anterior opening including a plurality of threads on an outside surface adjacent the anterior opening, and a posterior opening connectable to the conduit. The cap 10, is as described above.

The invention also includes a method of venting residual pressure from a fluid system having at least one capped threaded fitting in fluid connection with the system. The method comprises disposing on the fitting a vented cap having complementary threads by screwing the cap onto the fitting until the connection is tightened and the fitting is in contact with a cap gasket as described above. The cap is disposed with a gasket 28 positioned between the plurality of threads 26 and the end wall 24 abuttingly contacting the sidewall 18 and the end wall, the gasket having a circumference complementary to the periphery of the inner cavity. Releasing residual fluid pressure after shut down of the system is accomplished by sufficiently loosening the vented cap 10 to break contact between the cap gasket 28 and the fitting 48 so that a fluid connection is established from the fitting into the plurality of vent slots 12 in the cap lugs 14 to therethrough release residual fluid pressure while keeping the vented cap sufficiently engaged with the fitting to remain thereon.

Accordingly in the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

The invention claimed is:

1. A vented cap for a pressurized fluid conduit, said cap comprising:

a cap body having a sidewall defining a generally cylindrical inner cavity having a first end and a second end spaced apart therefrom, a mouth defined by a periphery of said sidewall at said first end and opening into said inner cavity, an end wall positioned at said second end so as to close said inner cavity, a plurality of threads positioned along an inner surface of said sidewall and extending generally from said mouth toward said end wall and ending spaced apart therefrom, and at least one lug member extending outwardly from an outer surface of said sidewall and having a lengthwise extent positioned generally parallel to a central axis of said inner cavity, said lug member having a vent slot extending along the lengthwise interior extent of said lug member so that the slot has a first end beginning at said mouth and a second end spaced apart from said end wall, the vent slot extending inwardly from said lug member toward said inner cavity through the sidewall and through the plurality of threads so as to form a vent opening into said inner cavity; and a gasket having a circumference complementary to the periphery of said inner cavity, said gasket positioned between said plurality of threads and said end wall abuttingly contacting said sidewall and said end wall.

2. The vented cap of claim 1, wherein said at least one lug member has a base coextensive with the outer surface of said sidewall, two lateral walls, and an end wall.

3. The vented cap of claim 1, wherein said at least one lug member has a base coextensive with the outer surface of said sidewall, two concavely arcuate lateral walls, and a convexly arcuate end wall.

4. The vented cap of claim 1, wherein said vent slot is positioned extending along a central lengthwise dimension of said at least one lug member.

5. The vented cap of claim 1, wherein said plurality of threads is cut along the vent opening to form a bevel having approximately a 45° angle to a center axis of said vent slot.

6. The vented cap of claim 1, wherein an inner surface of said end wall includes a central concavity which extends to form a knob protruding from an exterior surface of said end wall.

7. The vented cap of claim 6, wherein said knob is generally outwardly cylindrical and includes an arcuate groove extending along a lateral circumference.

8. The vented cap of claim 7, further comprising a chain fastened around said arcuate groove.

9. The vented cap of claim 1, wherein said end wall further comprises a shelf positioned peripherally along an inner surface of said end wall, the shelf being slightly raised above a central area of the inner surface of said end wall.

10. The vented cap of claim 1, wherein said gasket seal is circular, having an inner diameter, an outer diameter, and a generally rectangular cross-section.

11. The vented cap of claim 10, wherein the generally rectangular cross-section includes a length lying along a radius of said Gasket.

12. The vented cap of claim 11, wherein the generally rectangular cross-section includes a height sufficient for an upper surface of the Gasket to be positioned approximately level with the second end of said vent slot.

13. A vented cap for a threaded conduit carrying a fluid under pressure, said cap comprising:

a cap body having at least one external lug, a central cap cavity and a plurality of threads peripheral thereto and complementary to said threaded conduit;

a slot cut within the at least one lug, said slot extending from the lug inwardly toward a central axis of the cap so as to communicate with a cap mouth opening and with said central cap cavity, said slot having a blind end terminating within the lug and spaced apart from a closed end of said cap; and a gasket positioned around a periphery of the central cap cavity at the closed end of said cap so as to prevent communication between the blind end of said vent opening and said central cap cavity when the cap is positioned sufficiently tightened onto said conduit.

14. The vented cap of claim 13, wherein said slot is positioned extending along a central lengthwise dimension of said at least one lug member.

15. The vented cap of claim 13, wherein said plurality of threads is cut along the slot to form a bevel having approximately a 45° angle to a center axis of said vent slot.

16. The vented cap of claim 13, further comprising a knob protruding from an exterior surface of a cap end wall.

17. The vented cap of claim 16, wherein said knob is generally outwardly cylindrical and includes a groove extending along a lateral circumference.

18. The vented cap of claim 17, further comprising a chain fastened around said groove.

19. A vented cap and fitting combination for a fluid conduit, said combination comprising:

a fitting having a generally hollow cylindrical body having an anterior opening including a plurality of threads on an outside surface adjacent said anterior opening, and a posterior opening connectable to said conduit; and a cap having a generally hollow cylindrical body having an inner cavity therein, an anterior opening including plurality of threads on an inside surface adjacent said anterior opening, a posterior end closed by an end wall, and a plurality of lugs extending outwardly from said body, each lug member of said plurality having a vent slot extending at least partly through the lengthwise interior extent of said lug member so that the vent slot has a first end beginning at said anterior opening and a second end spaced apart from said end wall, the vent slot extending from said lug member inwardly toward said inner cavity through a sidewall of the body and through the plurality of threads so as to open into said inner cavity; and a gasket having a circumference complementary to the periphery of said inner cavity, and positioned between said plurality of threads and said end wall abuttingly contacting said sidewall and said end wall.

20. The combination of claim 19, wherein said at least one lug member has a base coextensive with the outer surface of said sidewall, two lateral walls, and an end wall.

21. The combination of claim 19, wherein said at least one lug member has a base coextensive with the outer surface of said sidewall, two concavely arcuate lateral walls, and a convexly arcuate end wall.

22. The combination of claim 19, wherein said vent slot is positioned extending along a central lengthwise dimension of said at least one lug member.

23. The combination of claim 19, wherein said plurality of threads is cut along the vent opening to form a bevel having approximately a 45° angle to a center axis of said vent slot.

24. The combination of claim 19, wherein an inner surface of said end wall includes a central concavity which extends to form a knob protruding from an exterior surface of said end wall.

25. The combination of claim 24, wherein said knob is generally outwardly cylindrical and includes an arcuate groove extending along a lateral circumference.

26. The combination of claim 25, further comprising a chain fastened around said arcuate groove.

27. The combination of claim 19, wherein said end wall further comprises a shelf positioned peripherally along an inner surface of said end wall, the shelf being slightly raised above a central area of the inner surface of said end wall.

28. The combination of claim 19, wherein said Gasket is circular, having an inner diameter, an outer diameter, and a generally rectangular cross-section.

29. The combination of claim 28, wherein the generally rectangular cross-section includes a length lying along a radius of said Gasket.

30. The combination of claim 29, wherein the generally rectangular cross-section includes a height sufficient for an upper surface of the Gasket to be positioned approximately level with the second end of said vent slot.

31. A method of venting residual pressure from a fluid system having at least one capped threaded fitting in fluid connection with the system, the method comprising:

disposing on the fitting a vented cap having complementary threads by screwing the cap onto the fitting until the connection is tightened and the fitting is in contact with a cap gasket, the cap having a generally hollow cylindrical body having an inner cavity therein, an anterior opening including plurality of threads on an inside surface adjacent said anterior opening, a posterior end closed by an end wall, and a plurality of lugs extending outwardly from said body, each lug member of said plurality having a vent slot extending at least partly through the lengthwise interior extent of said lug member so that the vent slot has a first end beginning at said anterior opening and a second end spaced apart from said end wall, the vent slot extending from said lug member inwardly toward said inner cavity through a sidewall of the body and through the plurality of threads so as to open into said inner cavity, said cap being disposed with a gasket positioned between said plurality of threads and said end wall abuttingly contacting said sidewall and said end wall, the gasket having a circumference complementary to the periphery of said inner cavity; and releasing residual fluid pressure after shut down of the system by sufficiently loosening the vented cap to break contact between the cap gasket and the fitting so that a fluid connection is established from the fitting into the plurality of vent slots in the cap lugs to therethrough release residual fluid pressure while keeping the vented cap sufficiently engaged with the fitting to remain thereon.

* * * * *